United States Patent [19]

Pedigrew

[11] Patent Number: 5,016,812

[45] Date of Patent: May 21, 1991

[54] SIFT-PROOF CARTON AND METHOD AND ADHESIVE DISPENSING MEANS FOR PRODUCING SAME

[75] Inventor: Colin Pedigrew, Erkrath, Fed. Rep. of Germany

[73] Assignee: Nordson Corporation, Westlake, Ohio

[21] Appl. No.: 435,514

[22] PCT Filed: Jan. 19, 1988

[86] PCT No.: PCT/US88/00099

§ 371 Date: Sep. 6, 1989

§ 102(e) Date: Sep. 6, 1989

[87] PCT Pub. No.: WO88/05382

PCT Pub. Date: Jul. 28, 1988

[30] Foreign Application Priority Data

Jan. 20, 1987 [EP] European Pat. Off. ..... 87100689.6

[51] Int. Cl.[5] ..... B65D 5/06

[52] U.S. Cl. ..... 229/132; 118/314; 118/315; 156/78; 156/578; 222/485; 229/136; 427/208.2; 427/286; 493/128; 493/131; 493/331; 493/333

[58] Field of Search ..... 229/132, 136; 493/128, 493/131, 331, 333; 427/286, 208.2; 118/314, 315, 323; 222/330, 481, 482, 484, 485; 53/383, 491; 156/78, 500, 578

[56] References Cited

U.S. PATENT DOCUMENTS

| | | | |
|---|---|---|---|
| 2,804,043 | 8/1957 | Netzley | 493/128 |
| 2,896,569 | 7/1959 | Ferguson, Sr. et al. . | |
| 3,018,701 | 1/1962 | Keely . | |
| 3,135,628 | 6/1964 | Johnson, Jr. et al. . | |
| 3,276,664 | 10/1966 | Johnson | 229/136 |
| 3,297,229 | 1/1967 | Bluem | 229/132 |
| 3,299,854 | 1/1967 | Van Loben Sels . | |
| 3,341,105 | 9/1967 | Curran | 229/132 |
| 3,397,832 | 8/1968 | Thiele | 229/132 |
| 3,482,489 | 12/1969 | Neal et al. . | |
| 3,831,342 | 8/1974 | Rejsa | 118/323 |
| 4,095,554 | 6/1978 | Moen . | |
| 4,157,149 | 6/1979 | Moen . | |
| 4,256,526 | 3/1981 | McDaniel | 118/313 |
| 4,420,510 | 12/1983 | Kunkel et al. | 427/286 |
| 4,578,054 | 3/1986 | Herrin | 493/131 |
| 4,687,137 | 8/1987 | Boger et al. | 118/315 |
| 4,836,440 | 6/1989 | French | 229/132 |

*Primary Examiner*—Gary E. Elkins

*Attorney, Agent, or Firm*—Wood, Herron & Evans

[57] ABSTRACT

The invention relates to a high-integrity closure, sift-proof carton [10], a method and an adhesive dispensing apparatus for producing same. Foamed hot melt adhesive is dispensed in parallel strips from dispensing guns onto the flaps [20], [22], [30], [32] of the carton [10], which are thereafter folded down to close the carton [10]. The strips can be spaced so that a continuous tight adhesive seal is formed, especially by providing a strip pattern interdigitating when the flaps contact each other. Since all strips are provided in parallel, while the carton is moved with respect to the dispensing apparatus, application of adhesive is fast and reliable.

15 Claims, 4 Drawing Sheets

SIFT-PROOF CARTON AND METHOD AND ADHESIVE DISPENSING MEANS FOR PRODUCING SAME

Figure 1:
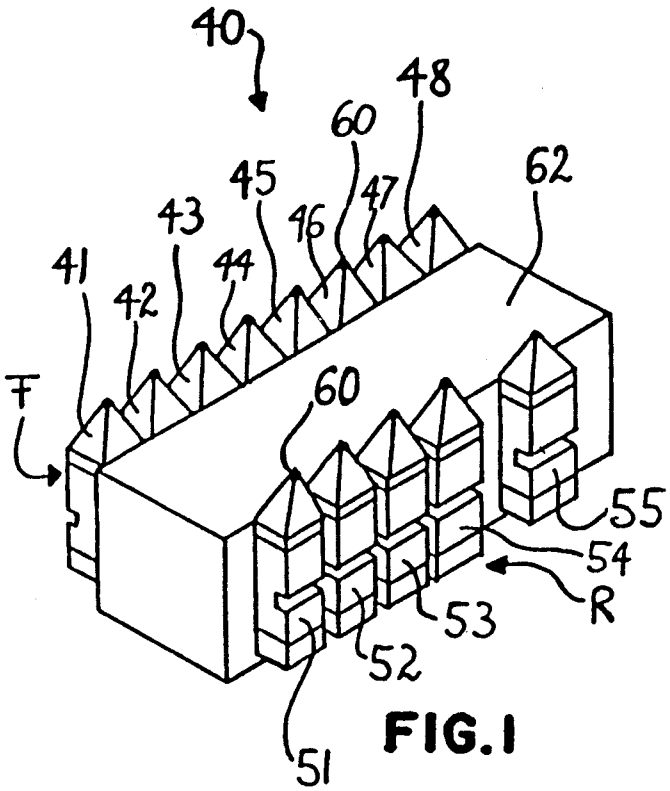

This invention relates to a high-integrity closure carton, a method and an adhesive dispensing means and apparatus for producing same.

Hot melt thermoplastic adhesives are commonly used in packaging and cartoning applications, where the quick setting time of this type of adhesive is advantageous. At the operating speeds of commercial cartoning machines, the use of chemical or cold adhesives has decreased because of the relatively long setting time required for such adhesives. Hot melt adhesive applied to the flaps of a carton sets relatively quickly and substantially reduces the time in which compressive forces must be applied to the flaps while the adhesive bonds as compared to cold glue.

Despite the improvement over cold adhesives, thermoplastic adhesives also present problems in packaging and cartoning applications.

One of the most common problems with hot melt adhesives is that of compressing the adhesive after application so as to obtain sufficient surface contact between the adhesive and adhered substrate to achieve a good bond. The relatively high viscosity, high surface tension, and quick setting time of hot melt adhesives all combine to prevent the adhesive from spreading over a large surface area when the adhesive is applied as a liquid to the substrate. Instead of spreading, the liquid sets up as a thick bead on the structure. Even when quickly compressed between two flaps of a carton, the adhesive has been found difficult to spread. In most instances, when the two flaps which have been adhered together are pulled apart, the bond breaks the adhesive-to-substrate interface. This means that in order to increase the strength of the bond, the area of the interface or surface contact between the adhesive and the substrate must be increased.

As described in detail in U.S. Pat. No. 4,059,466, assigned to the assignee of this invention, it has been discovered that the adhesive strength of a bond achieved with a given quantity of hot melt adhesive may be appreciably improved if the adhesive is applied as a cellular foam rather than as a conventional non-foamed adhesive. A method of making and applying foamed hot melt adhesive is described in detail in said U.S. Pat. No. 4,059,466. The increased bonding strength of the foamed adhesive results at least in part from the fact that the foamed adhesive may be spread over at least twice the area compared with the same adhesive in the non-foamed state under the same compressive conditions. Since the strength of the bond is a function of the area wetted or covered by the adhesive, foaming of adhesive results in a bond approximately twice as strong as the same quantity of unfoamed adhesive. Expressed another way, the same bond strength may be achieved with approximately half the quantity of foamed adhesive compared with unfoamed adhesive, because of the much larger area wetted or covered by the foamed adhesive under the same compressive conditions.

So-called sift-proof cartons are high-integrity closure cartons usually fabricated by applying a block C- or block U-shaped pattern of adhesive to the end flap structure of a four-sided carton to form a continuous line or bead of adhesive along the carton edges to eliminate any minute channels or openings through which granular material in the carton could leak. In one type of four-sided carton, for example, the four flaps at each end of the carton include a pair of opposed minor flaps, and an inner major flap and outer major flap which are each formed with a width equal to the depth of the carton. In sealing the end flaps of such four-sided, sift-proof cartons, the opposed minor flaps are first folded inwardly toward the center of the carton. The two major flaps are placed in an open or spread position to receive hot melt adhesive. Usually, at least one strip or ribbon of hot melt adhesive is applied to each end of the inner major flap, transverse to its fold line. The outer major flap receives a block C-or a block U-shaped strip of hot melt adhesive including a strip at each end perpendicular to its fold line, and a third strip extending longitudinally between the outer strips along the leading edge of the flap and generally parallel to its fold line.

The sealing operation is completed by first folding the inner major flap onto the minor flaps beneath. The outer major flap is then folded over the inner major flap, and its U-shaped strip of adhesive contacts the ends and center portion of the exposed surface of the inner major flap beneath. Both the inner and outer major flaps extend across the entire depth of the carton. One example of this method of forming a sift-proof seal at the end flaps of a carton is shown in U.S. Pat. No. 3,831,342.

Since both of the major flaps in cartons such as disclosed in U.S. Pat. No 3,831,342 are formed with a width equal to the depth of the carton, they extend across the entire bottom or top of the carton when folded. This is required to ensure that a continuous bead or barrier of adhesive is formed at the ends of the carton between the outer major flap and the inner major flap.

Sift-proof cartons of the type described above require a substantial amount of cold setting or hot melt adhesive to obtain the desired bond strength and to create a continuous barrier of adhesive between the flaps where product could leak out of the carton.

Another type of sift-proof carton employs shortened or economy inner and outer major flaps to save on carton material. These sift-proof cartons are the same as that shown in U.S. Pat. No. 3,831,342 except the inner and outer major flaps extend only part way across the top or bottom of the carton instead of all the way across.

In sealing the end structure of a four-sided, sift-proof carton with economy major flaps, the opposed minor flaps are first folded inwardly toward the center of the carton. The two major flaps are placed in an open or spread position to receive hot melt adhesive. A strip or ribbon of hot melt adhesive is applied to each end of the inner major flap, transverse to its fold line, which is then folded onto the exposed surfaces of the minor flaps. When folded onto the minor flaps, the inner major flap forms a gap or space between its leading edge and the fold line of the outer major flap because the inner major flap extends only part way across the carton. In order to form a sift-proof seal, the gap or space between the leading edge of the inner major flap and the fold line of the outer major flap overlying the minor flaps must be filled with adhesive.

It has been the practice in the prior art to form a sift-proof seal in cartons having economy major flaps to dispense a large quantity of hot melt adhesive onto the ends of the outer major flap transverse to its fold line so that when the outer major flap is folded into position, the hot melt adhesive fills the entire gap overlying the minor flaps between the leading edge of the inner major flap and the fold line of the outer major flap.

One problem with sift-proof seals of the type described above for cartons having economy flaps is that a large quantity of hot melt adhesive must be used to ensure that a continuous, sift-proof seal is created in the gap overlying the minor flaps. This is due to the fact that hot melt adhesive has high viscosity and high surface tension which limits its spreadability , as discussed above. In using large quantities of hot melt adhesive, some of the adhesive is squeezed out from between the flaps when the outer major flap is folded in place. This creates either a sloppy looking seal or a seal which requires a further operation to remove the excess adhesive squeezed from underneath the flaps. Such an additional adhesive removing operation adds to the cost of fabricating sift-proof seals of this type.

In sift-proof sealing cartons with full-width flaps or economy cartons by means of providing a block U-or block C-shaped of adhesive material strips on at least one of the carton flaps before closing the carton as described above, strips must inevitably be provided which extend in different main directions. Thus, in the block U-shaped pattern of adhesive material strips of U.S. Pat. No. 3,831,342, the two shorter strips at the ends of the inner and outer major flaps extend from the fold line towards the leading edge of said major flaps, while a longer strip extends substantially normal to said shorter strips, parallel to the leading edge and from one outer major flap end to the opposite outer major flap end.

Providing this pattern of adhesive material strips therefore usually requires that either the carton or the adhesive dispensing means is moved in two different directions, which directions are perpendicular to each other. Therefore, the corresponding adhesive application procedure is comparatively slow and requires device structures making such a movement possible. This adds to the expense of the manufacturing procedure.

If alternatively only movement of adhesive dispensing means and carton with respect to each other in one direction is desired, the strips extending parallel to the direction of movement could be produced by means of a conventionally apertured gun nozzle, while the strips extending perpendicular thereto could be produced by a slot nozzle. Thus in the case of a four-sided carton with minor flaps connected to the short sides and major flaps connected to the long side thereof, the strip extending between the ends of the outer major flap substantially parallel to the fold line thereof could be provided as a bead by dispensing said strip from a conventional dispensing gun. The shorter strips at the outer major flap ends and the inner major flap ends, which extend from the fold line to the leading edge of said major flaps, could be produced by correspondingly shaped slot nozzles. Yet it is difficult to evenly dispense foamed hot melt adhesive from slot nozzles, so that dispensing the hot melt adhesive from conventional dispensing guns with small orifices is preferable.

It is an objective of this invention to provide a high-integrity closure carton and a method of manufacture, which provides a high strength, sift-proof seal of the flaps at each end of the carton while being faster and simpler in manufacture. A further objective is to provide an adhesive dispensing means by which said carton can be manufactured according to said method.

In order to accomplish this and other objectives, the carton and the method of the initially mentioned kind are, according to this invention, characterized that all strips of adhesive material consist of foamed adhesive material and all said strips extend in their direction of elongation substantially parallel to each other and to the fold lines of the major flaps.

The adhesive dispensing means of the initially mentioned kind is, according to this invention, characterized by a plurality of adhesive material dispensing outlet means each connected with a supply means for feeding liquid adhesive material to the outlet means from a source of liquid adhesive material and each provided with an outlet orifice for liquid adhesive material, the outlet means being disposed in at least one row extending substantially transversely to the direction of dispensing movement of the adhesive dispensing means and/or of the container, respectively, so that elongated strips of adhesive material are dispensed from the outlet orifices onto the container flaps during the dispensing movement of the adhesive dispensing means and/or the container, respectively, the direction of elongation of the strips being substantially parallel to the dispensing movement direction and all strips being substantially parallel to each other.

In the course of the following discussion of advantages provided by this invention and the description of presently preferred embodiments thereof, reference will be made to four-sided cartons having two opposed short sides, to which minor flaps are attached along fold lines, and opposed long sides, to which major flaps are attached along fold lines. It should yet be borne in mind, that this invention is in no way restricted to the sealing of such cartons and would be applicable as well to cartons with all sides of equal length. In fact, this invention is neither restricted to four-sided cartons either, but also advantageous for other kinds of flapped cartons and containers.

Figure 3:
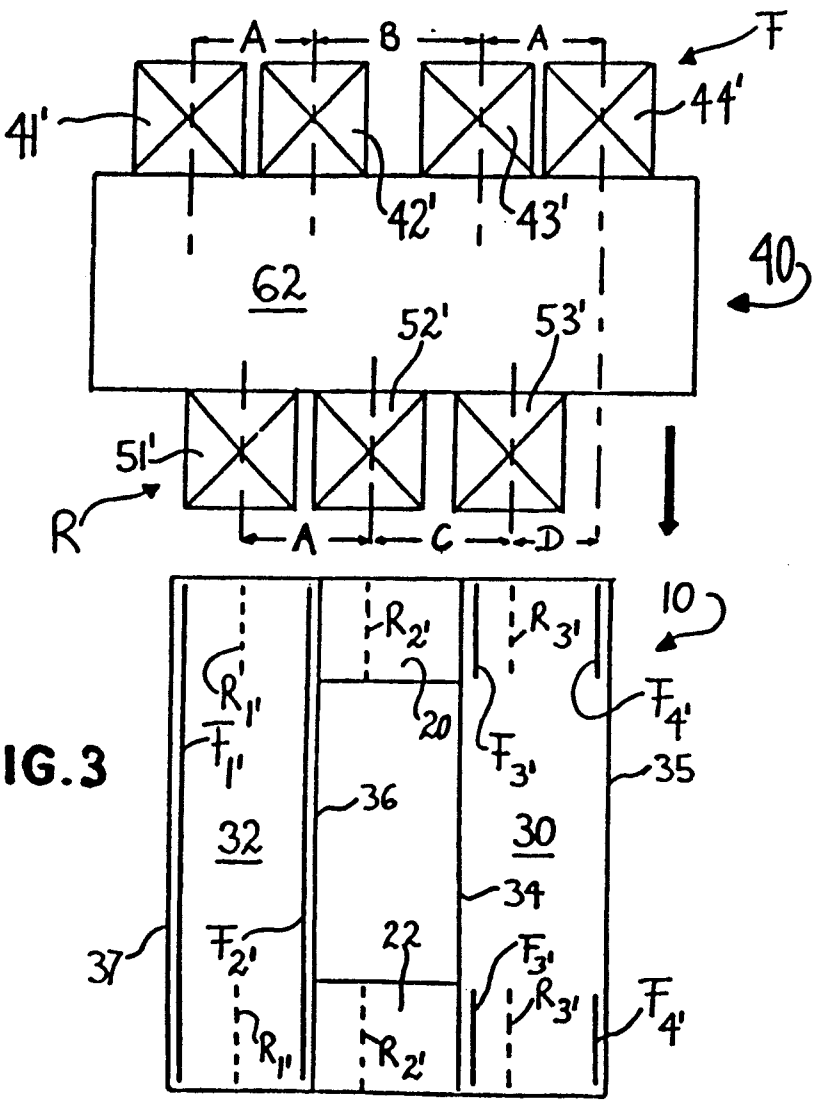
Figure 2:
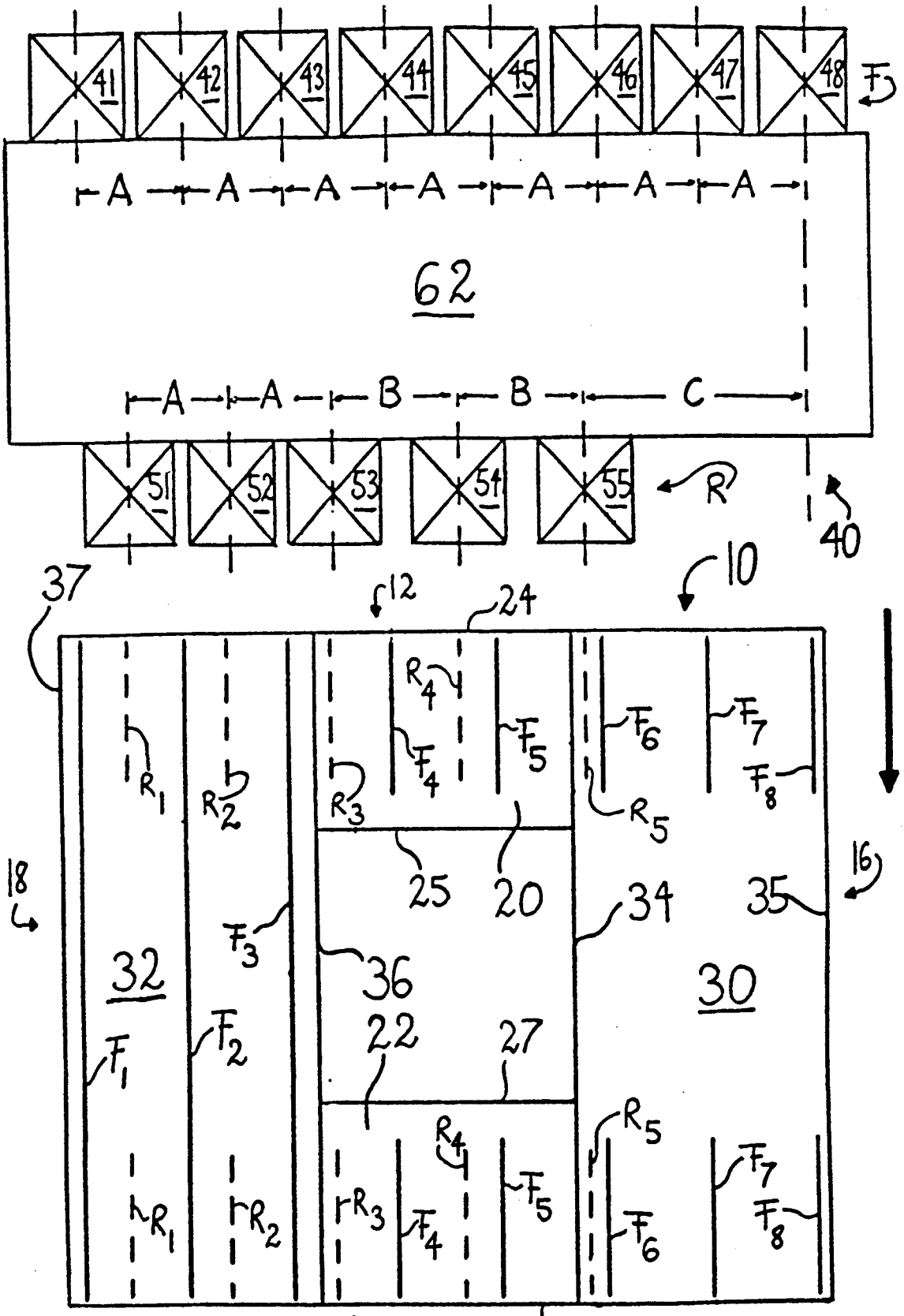
Figure 4:
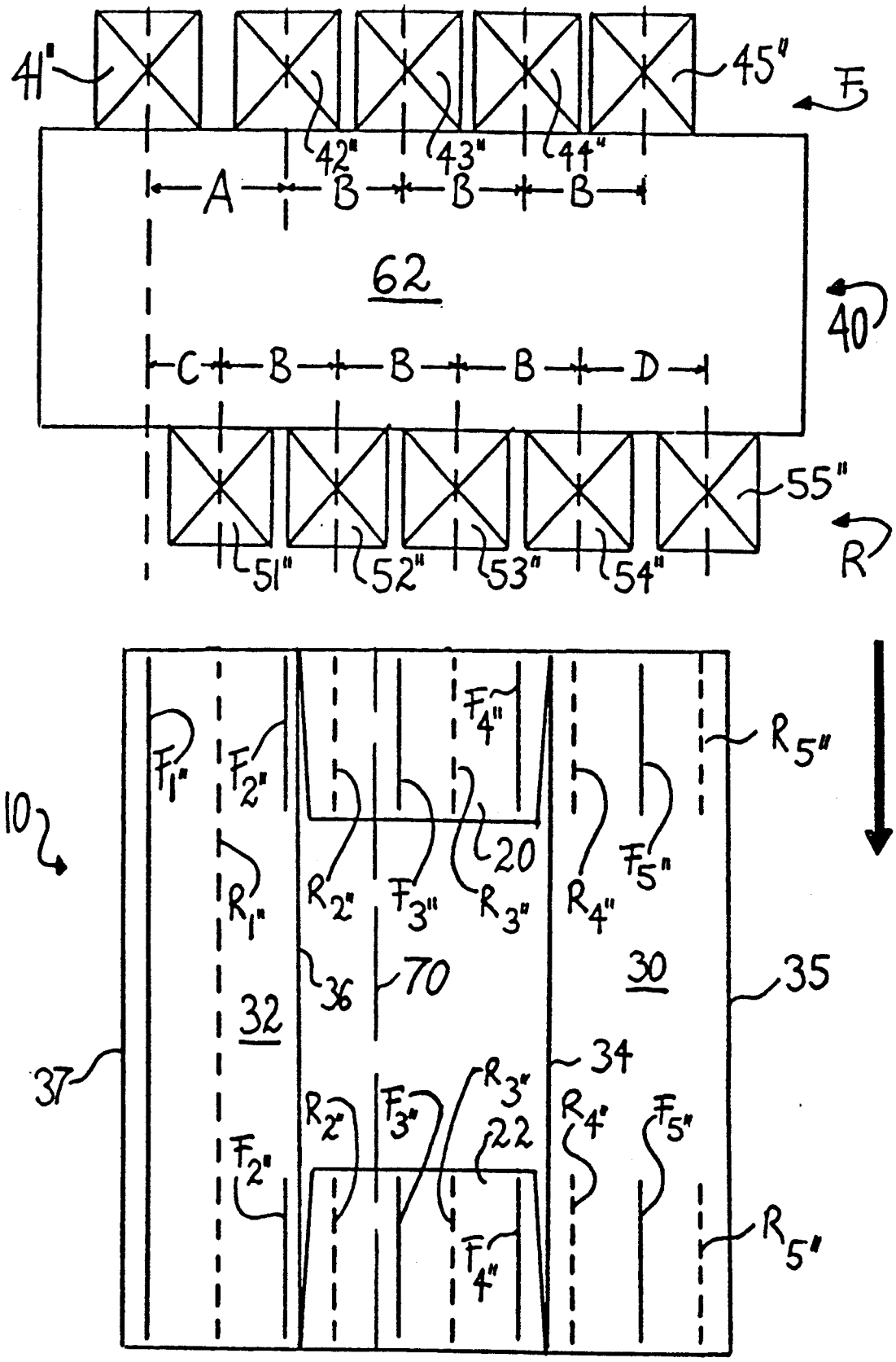

The invention will now be described in greater detail with reference to the corresponding figures, which show:

FIG. 1 a schematic perspective view of an adhesive dispensing means according to this invention;

FIG. 2 an enlarged plan view of the adhesive dispensing means of FIG. 1 and a plan view of a four-sided carton provided with strips of adhesive material for sift-proof sealing;

FIG. 3 another embodiment of an adhesive dispensing means according to this invention and of the adhesive material strip pattern provided thereby on carton flaps, FIG. 4 yet another embodiment of the adhesive dispensing means according to this invention and the adhesive material strip pattern provided by this dispensing means on carton flaps, and FIG. **5*a*–5*d* an interdigitating strip pattern provided by a modified adhesive dispensing means according to FIG. 4** and the steps of closing a carton provided with said interdigitating strip pattern.

According to this invention, a four-sided carton is provided having opposed minor flaps formed at each end of two opposed short sides of the carton and opposed inner and outer major flaps formed at each end of the other two opposed sides of the carton, which sides are longer than the sides having the minor flaps. All of the flaps are joined to the carton sides at a fold line and include a leading edge opposite the fold line. While in the case of the embodiments of FIGS. 2 and 3 to be described later, the inner and outer major flaps extend across the gap of the carton, the embodiments of FIGS.

4 and 5 concern an economy carton, wherein the inner and outer major flaps are formed with a transverse dimension between their fold lines and leading edges which is less than the depth of the bottom or top of the carton.

In forming the carton of this invention, the top and bottom of the carton are sealed in identical fashion in a sequence, wherein the bottom flaps are first sealed to permit the carton to be filled with a granular product, and the top flaps are thereafter sealed to close the carton.

In the practice of this invention, each end of the carton is closed and sealed by first folding the minor flaps inwardly from a spread position toward the center of the carton to a folded position substantially perpendicular to the carton sides. Foamed hot melt adhesive is applied to the minor flaps in their folded position and to each of the inner and outer major flaps in their spread or open position. The application of the hot melt adhesive from the adhesive dispensing means onto the minor flaps in their folded position and onto the major flaps in their spread position proceeds by either moving the adhesive dispensing means in a dispensing direction parallel to the long sides of the carton, or by moving the carton in said direction with respect to the adhesive dispensing means. During this application, adhesive material is dispensed through nozzle orifices of the adhesive dispensing means and is, due to the movement of the adhesive dispensing means or the carton, applied onto the carton flaps in the form of parallel elongated strips or beads, which extend in their elongation direction substantially parallel with the long sides of the carton.

The strips of adhesive material on the minor flaps and on the inner major flaps extend substantially over the same length, and the middle area of the inner major flap remains free from adhesive material. Thus, only the areas of the minor flaps and inner major flaps which are in contact with each other in the folded position receive foamed hot melt adhesive. On the outer major flap, at least one strip of foamed hot melt adhesive is applied, which extends substantially from one end of the outer major flap, parallel to the fold line thereof, to the other end of the outer major flap.

The inner major flap is next folded onto the exposed top surfaces of the minor flaps, forming a sift-proof seal at the outer edges of the inner major flap, where the foamed hot melt adhesive meets the minor flaps. The spacing of the parallel strips on the inner major flap ends and the amount of foamed adhesive material forming the strips or beads are chosen so that a continuous layer of foamed hot melt adhesive is formed between the ends of the inner major flap and the exposed surfaces of the minor flaps, when the inner major flap is pressed down onto the minor flaps and the foamed hot melt adhesive is squeezed and thereby spread out. Since in the applications considered here, the strips or beads of foamed hot melt adhesive on the inner major flap ends cannot be spaced very close to each other, so that a continuous layer might not be reliably formed when folding the inner major flap onto the minor flaps, additional strips of foamed hot melt adhesive are dispensed onto the surfaces of the minor flaps. These strips or beads on the minor flaps are provided at portions of the minor flap surfaces, which would not be contacted by a strip dispensed onto the inner major flap, e.g. a strip or bead of foamed hot melt adhesive is provided on the minor flap to interdigitatingly contact the inner major flap end at the folding thereof in an area between two strips of foamed hot melt adhesive dispensed onto the inner major flap. For other applications, the strips on the minor flaps may not be necessary.

If an economy carton is to be sealed, the leading edge of the inner major flap is spaced from the fold line of the outer major flap forming a gap therebetween and overlying each of the minor flaps beneath, since the width of the inner major flap is less than the depth of the bottom (or top) of the carton.

The sealing operation of the bottom and/or the top of the carton, respectively, is completed by folding the outer major flap toward the center of the carton from its spread position to its folded position. The leading edge of the outer major flap contacts a portion of the exposed surface of the inner major flap. Its end portions overlie the end portions of the upper surface of the inner major flap, if the inner major flap extends across the hole depth of the carton or the end portions of the outer major flap overlie portions of the minor flaps in the gap between the leading edge of the inner major flap and the fold line of the outer major flap (in the case of economy cartons). The width of the outer major flap is, in both cases, such that the strip of foamed hot melt adhesive extending between the opposed ends of the outer major flap contacts the exposed surface of the inner major flap forming a sift-proof seal therebetween. In the case of an economy carton, this through-going strip of foamed hot melt adhesive on the outer major flap preferably extends adjacent to the leading edge of the inner major flap and, in case, embeds said leading edge at least partly. In this case, a further strip of foamed hot melt adhesive is preferably provided closer to the leading edge of the outer major flap to adhere said leading edge to the surface of the inner major flap.

The further strips of foamed hot melt adhesive on each end of the outer major flap form a continuous layer between the upper surface of the inner major flap and the underside of the outer major flap, which layer extends from the fold line of the outer major flap at least to the through-going strip of foamed hot melt adhesive (full-depth major flaps). In the case of an economy carton, strips of foamed hot melt adhesive on each end of the outer major flap fill the gaps along the minor flaps between the leading edge of the inner major flap and the fold line of the outer major flap.

A sift-proof seal is thus formed along all four edges of the top and/or bottom of the carton.

The application of parallely extending strips of foamed adhesive according to this invention is preferably carried out by means of an adhesive dispensing means, which comprises a plurality of adhesive material dispensing outlet means. These outlet means are each connected with a supply means for feeding liquid adhesive material to the outlet means from a source of liquid adhesive material and are each provided with an outlet orifice for liquid adhesive material. Preferably, these outlet means are embodied as individual adhesive material dispensing guns of the zero cavity type, and are each provided with a return means for circulating the liquid adhesive material when the gun outlet orifice is closed. The individual dispensing guns are advantageously provided in two parallel rows, which both extend transversely to the direction of dispensing movement of the adhesive dispensing means or the carton, respectively. This allows the parallel strips or beads of foamed hot melt adhesive to be spaced closer to each other, since with the dispensing guns provided adjacent to each other in only one row, the minimum distance between two strips or beads of foamed adhesive material would be determined by the distance between the outlet orifices of immediately adjacent dispensing guns. Arranging the guns in two separate, parallel rows makes it possible to provide the dispensing gun nozzles of one row in misalignment with the nozzles of the other row, as viewed along the direction of dispensing movement, so that a dispensing gun contained in one of the rows can e.g. place a bead of foamed hot melt adhesive between two such beads dispensed from neighbouring dispensing guns of the other row, thereby making smaller distances between neighbouring beads possible.

In this connection, it should be borne in mind that a zero cavity nozzle is generally the only way to provide good cut-off with foamed adhesives. A zero cavity nozzle provides the valving effect or cut-off immediately at the nozzle's exit port. Yet the commonly used zero cavity nozzles permit no closer spacing between adjacent strips of foamed adhesive than a $\frac{7}{8}$-inch spacing. The abovementioned arrangement of guns in two separate, parallel rows in misalignment provides a 7/16-inch spacing. Yet even this spacing can in some cases be still to far part to permit squeeze-out of the strips to obtain a fully continuous adhesive layer and completely filled gaps.

In this connection, the interdigitating arrangement of strips or beads on minor and major flaps already mentioned is advantageous, since this interdigitation of the strips puts same close enough together to permit squeeze-out of the foamed adhesive to provide a complete seal.

One advantage of this invention is that the use of foamed hot melt adhesive substantially reduces the quantity of adhesive required to obtain a sift-proof seal of the end flaps of a carton, compared to prior art cartons sealed with non-foamed hot melt adhesive or cold setting adhesive. The relatively small quantity of foamed adhesive applied to the ends of the outer flaps does not squeeze out from underneath said flaps, but is spread evenly into a continuous layer and requires not further operation to clean excess adhesive from the edges of a carton.

In addition to the savings of adhesive, the sift-proof carton of this invention is easier to fabricate in a high speed production run, since only movement in one direction of either the adhesive dispensing means or the carton is required and the use of slot nozzles for dispensing transversely extending beads is obviated. Economy cartons can be sift-proof sealed according to this invention, requiring less carton material in forming the flaps than in some prior art cartons. The spaces between the leading edge of the inner major flap and the opposite side of the economy carton, which overlie the minor flaps, are filled by the foamed hot melt adhesive strips applied to the outer major flap. A relatively small quantity of foamed hot melt adhesive thus fills in the portion of the bottom or top of the economy carton, which in full-depth flap carton is occupied by the flap extending across the entire bottom or top of the carton. In an economy carton according to this invention, the top or bottom of the carton is thus partially formed by the inner major flap and the minor flaps beneath and the cellular, foamed hot melt adhesive extending beneath the outer major flap in the gap formed by the inner major flap The adhesive dispensing means according to this invention is not subject to clogging or blocking to any marked degree, since it is constructed from individual dispensing guns each provided with means for circulating hot melt in case the nozzle is closed. The adhesive dispensing means can be used in the bottom sealing station as well as in the top sealing station, since it can dispense foamed hot melt adhesive in an upward as well as in a downward direction. The individual dispensing guns can be easily positioned to provide strips or beads of hot melt adhesive at exactly the required positions on the carton flaps. The adhesive dispensing means is therefore highly versatile and easily adaptable to different sizes, shapes a.s.o. of cartons. If the number of strips or beads of foamed hot melt adhesive material to be dispensed onto the carton flaps varies between individual application cases, the adhesive dispensing means of this invention can be easily adapted to such modified situations, since the individual guns can be individually operated. Therefore, if in one application case the number of beads to be dispensed is reduced, some of the dispensing guns can be left shut, while only the remaining guns are operated to dispense foamed hot melt adhesive onto the carton flaps.

Referring now to FIG. 1, a schematic view of an adhesive dispensing means according to this invention is illustrated, which can be used at a bottom sealing station as well as in a top sealing station.

The adhesive dispensing means 40 comprises a mounting block 62 of substantially rectangular ground section. Of course, this mounting block 62 could also have any other suitable external shape.

Along two opposed long sides of the mounting block 62, foamed hot melt adhesive dispensing guns are provided in a front row F and a rear row R. As FIG. 1 shows, the front row F and the rear row R extend substantially parallel to each other. The front adhesive dispensing guns 41–48 of the front row F are disposed immediately adjacent one another, with only a small gap remaining between neighbouring guns. The rear adhesive dispensing guns 51–55 of the rear row R are partly spaced at greater intervalls.

In the context of a carton filling and sealing system with bottom sealing station, filling station and top sealing station, adhesive dispensing means 40 as shown in FIG. 1 is provided with the front row F and the rear row R extending transversely to the path of movement of the carton to be sealed (or the direction of dispensing movement of the adhesive dispensing means 40, if instead said dispensing means 40 is moved and the carton is kept stationary). Each dispensing gun 41–48, 51–55 in the front row F and the rear row R has a gun nozzle 60, through which hot melt adhesive material supplied to the gun from a suitable source (not shown) is dispensed onto carton flaps.

FIG. 2 shows a plan view of the adhesive dispensing means (top of Figure) and the pattern of parallel beads of foamed adhesive material dispensed from said dispensing means onto the flaps of a carton (bottom of FIG. 2).

As FIG. 2 shows, the front adhesive dispensing guns 41–48 of front row F are all spaced at equal distances. A from each other and are thus mounted to one long side of mounting block 62. The rear adhesive dispensing guns 51–55 of the rear row R are mounted to the opposite long side of mounting block 62, with the distances A between the first and second rear gun 51, 52 and the second and third rear gun 52, 53 being equal. The distance B of the fourth rear dispensing gun 54 to the third dispensing gun 53 and of the fifth rear dispensing gun 55 to the fourth rear dispensing gun 54 is somewhat larger. Even larger is the distance C between the fifth rear dispensing gun 55 and an imagined straight line through the nozzle orifice of front dispensing gun 48, which straight line extends perpendicular to the rows F, R and parallel to the dispensing direction.

The carton 10 shown in FIG. 2 has two opposed short sides 12, 14 and two opposed long sides 16, 18. To the short sides 12, 14, minor flaps 20, 22 are attached, which in FIG. 2 are shown folded about their respective fold lines 24, 26 towards the center of the carton 10, so that leading edges 25, 27 of the minor flaps 20, 22 lie in the top plane of the carton 10.

To the long sides 16, 18 of carton 10 an inner major flap 30 and an outer major flap 32 are attached along respective fold lines 34, 36. The major flaps 30, 32 are shown in FIG. 2 in their spread position relative to the sides of the carton, with the leading edges 35, 37 of the major flaps 30, 32 pointing away from the carton sides 16, 18.

Thus, the minor flaps 20, 22 and major flaps 30, 32 lie substantially in the same plane and can therefore be presented near the adhesive material dispensing means 40 with substantially the same distance between the dispensing nozzles thereof and all flaps. Since the minor flaps 20, 22 are in their folded position, whereas the major flaps 30, 32 are in their spread position, the exposed upper surfaces of the minor flaps 20, 22 are presented to the adhesive material dispensing means 40, while the undersides of the major flaps 30, 32 are exposed to said means.

The situation notable from FIG. 2 arises, after the top (or the bottom) of carton 10 has passed underneath (or above) adhesive dispensing means 40. The direction of movement during this passage is indicated by an arrow (not referenced) on the right side of FIG. 2.

The carton 10 is thus shown in FIG. 2 already provided with the beads of foamed adhesive material, which were dispensed from the adhesive dispensing means 40 while the carton 10 moved underneath (or above) the dispensing means 40 in the arrow direction. The beads of foamed hot melt adhesive material dispensed by the front adhesive dispensing guns 41–48 in front row F are indicated by continuous lines $F_1$–$F_8$, while the beads of foamed hot melt adhesive material dispensed from the rear adhesive dispensing guns 51–55 in rear row R are indicated by broken lines $R_1$–$R_5$ in FIG. 2.

As can be noted from FIG. 2, front adhesive dispensing gun 41 has dispensed a continuous bead of foamed adhesive material $F_1$ onto the outer major flap 32 near to the leading edge 37 thereof. This continuous bead $F_1$ extends from one end of outer major flap 32 to the opposite end thereof. Front adhesive dispensing guns 42 and 43 have similarly dispensed through-going beads $F_2$ and $F_3$ onto outer major flap 32, bead $F_2$ being positioned near the mid section of outer major flap 32, while bead $F_3$ is positioned close to the fold line 36 of outer major flap 32. The rear adhesive dispensing guns 51 and 52, the nozzles of which are situated approximately in the middle of the gap between the nozzles of front adhesive dispensing gun 41, 42 and 42, 43, respectively, have dispensed shorter, not through-going beads $R_1$ and $R_2$ of foamed hot melt adhesive material onto outer major flap 32. These rear gun beads extend only in the end sections of outer major flap 32 and lie between the through-going front adhesive gun beads $F_1$, $F_2$ and $F_3$.

Front adhesive dispensing guns 44 and 45 have dispensed beads $F_4$ and $F_5$ onto the exposed surfaces of minor flaps 20 and 22, and rear dispensing guns 53 and 54 have dispensed bead $R_3$ and $R_4$ onto portions of the exposed surfaces of minor flaps 20 and 22, onto which portions front adhesive dispensing guns 44 and 45 cannot dispense such beads due to their position in front row F. All beads of foamed adhesive material on the minor flaps extend between the fold line 24, 26 and the corresponding leading edge 25, 27 of each minor flap 20, 22.

Front adhesive dispensing guns 46, 47 and 48 have dispensed beads $F_6$, $F_7$ and $F_8$ of foamed hot melt adhesive material onto inner major flap 30, and rear adhesive dispensing gun 55 has dispensed bead $R_5$ onto inner major flap 30 between fold line 34 of inner major flap 30 and front gun bead $F_6$.

Front dispensing gun beads $F_6$–$F_8$ are positioned on inner major flap 30 substantially similar to the positioning of through-going beads $F_1$–$F_3$ on outer major flap 32, but are discontinued in the middle area of inner major flap 30, since this area does not contact an underlying minor flap surface when inner major flap 30 is folded onto the minor flaps 20, 22.

Setting out from the situation as shown in FIG. 2, inner major flap 30 is folded from its spread position as shown towards the center of carton 10, until it overlies minor flaps 20 and 22. The beads on the minor flap surfaces and on inner major flap 30 are positioned, so that in the cause of this folding, most beads on inner major flap 30 contact the surfaces of minor flaps 20 and 22 interdigitatingly at portions thereof which are not themselves provided with beads of foamed adhesive material. When pressing inner major flap 30 onto minor flaps 20 and 22, the beads on the surfaces of the minor flaps 20 and 22 and the beads dispensed onto inner major flap 30, which lie parallel and adjacent to each other, are spread out and contact each other to form a continuous layer of foamed adhesive material between the surfaces of the minor flaps 20, 22 and the underside of inner major flap 30. This layer extends from the fold line 34 to the leading edge 35 of inner major flap 30 and also extends over the greatest part of the area between fold lines 24, 26 and leading edges 25, 27 of minor flaps 20, 22.

Thereafter, outer major flap 32 is folded towards the center of carton 10, until it lies atop the upper surface of inner major flap 30. The beads $F_1$–$F_3$, $R_1$ and $R_2$ of foamed adhesive material on outer major flap 32 form a continuous layer of foamed adhesive material in the end sections of outer major flap 32, and the through-going bead $F_3$ near to the fold line 36 of outer major flap 32 and therefore near to the leading edge 35 of downfolded inner major flap 30 links these continuous layers, forming a sift-proof seal through which no granular or powdery material contained in carton 10 can escape. Through-going adhesive beads $F_1$ and $F_2$ in this case serve to adhere the outer major flap 32 reliably to inner major flap 30 and further contribute to the end sections of outer major flap 32.

The embodiment shown in FIG. 3 resembles the above-discussed embodiment of FIG. 2 in most pertinent aspects, so that the discussion of this embodiment can be limited to some extent.

The adhesive dispensing means 40 of this embodiment has only four front adhesive dispensing guns 41'–44' in a front row F, and three rear adhesive dispensing guns 51'–53' in a rear row R. The distance between the first and second front adhesive dispensing gun 41', 42' and that between the third and fourth front adhesive dispensing guns 43' and 44' are small and of equal size, while the distance between the second and third front adhesive dispensing guns 42', 43' is somewhat greater, as referenced A, B in FIG. 3. The distance A between rear adhesive dispensing guns 51' and 52' is again small, while the distance C between second and third rear adhesive dispensing gun 52', 53' is greater. Again, the nozzle orifices of the rear row dispensing guns 51'-53' are misaligned with respect to those of the front row dispensing guns 41'-44'.

In a dispensing process analogous to that described above with reference to FIG. 2, the carton 10 of FIG. 3 has been provided with beads of foamed hot melt adhesive material dispensed from the front and rear adhesive dispensing guns 41'-44', 51'-53' of adhesive dispensing means 40 while passing underneath (or above) same. Outer major flap 32 has been provided with two through-going beads $F_1'$, $F_2'$ dispensed from front dispensing guns 41', 42', which beads lie close to the leading edge 37 and the fold line 36 of outer major flap 32, respectively. Between said through-going beads $F_1'$, $F_2'$, beads $R_1'$ have been provided by rear dispensing gun 51', which beads $R_1'$ extend only in the end sections of outer major flap 32. Onto the exposed surfaces of minor flaps 20, 22, beads $R_2'$ have been dispensed from rear dispensing gun 52', which beads $R_2'$ extend between the fold line and the leading edge of each minor flap 20, 22.

Inner major flap 30 has been provided by front adhesive dispensing guns 43' and 44' with beads $F_3'$ and $F_4'$ of foamed hot melt adhesive material, and by rear adhesive dispensing gun 53' with bead $R_3'$, all of which beads are provided only in the end sections of inner major flap 30 overlying minor flaps 20, 22.

When inner major flap 30 is folded about its fold line 34 onto the exposed surfaces of minor flaps 20, 22, the beads $R_2'$ dispensed onto the minor flaps come to lie between bead $R_3'$ and $F_4'$ on inner major flap 30. When inner major flap 30 is pressed down onto minor flaps 20, 22, the adjacent, parallel beads $F_3'$, $F_4'$ and $R_2'$, $R_3$ are spread out and merge to form a continuous layer of foamed hot melt adhesive material between minor flaps 20, 22 and inner major flap 30 in the end sections thereof.

When thereafter, outer major flap 32 is folded about its fold line 36 to lie atop inner major flap 30, through-going bead $F_2'$ of foamed hot melt adhesive material, which extend close to the fold line 36 of outer major flap 32 contact inner major flap 30 close to the leading edge 35 thereof and connect the layers of hot melt adhesive at the end sections thereof to form a sift-proof seal. Bead $R_1'$ and $F_1'$ on outer major flap 32 in this case again serve mainly to adhere outer major flap 32 firmly atop inner major flap 30.

FIG. 4 shows a situation similar to that already discussed with reference to FIGS. 2 and 3, but with carton 10 being an economy carton. Thus, the dimension of inner major flap 30 and outer major flap 32 between fold line 34, 36 and leading edge 35, 37 is smaller than the depth of the carton. This is indicated by discontinuous line 70 in FIG. 4, which indicates the position of leading edge 35 of inner major flap 30 in the folded position of inner major flap 30.

Adhesive dispensing means 40 in this embodiment is provided with five front dispensing guns 41''-45'' mounted along one long side of mounting block 62 to form a front row F, and with five rear dispensing guns 51''-55'' mounted along the opposite long side of mounting block 62 to form a rear row R. The distance A between the nozzle of first front adhesive dispensing gun 41'' and second front adhesive dispensing 42'' is bigger than the (equal) distances B between the other front adhesive dispensing guns 42''-45'' in front row F. The first four of rear adhesive dispensing guns 52''-54'' are spaced from each other at a narrow distance, while the distance between the fifth rear adhesive dispensing gun 55'' to the fourth rear adhesive dispensing gun 54'' is somewhat greater. Again, the nozzles of the rear adhesive dispensing guns 51''-55'' in rear row R are misaligned with respect to the nozzles of front adhesive dispensing guns 41''-45'' in front row F, when viewed in the dispensing direction indicated by the arrow on the right side of FIG. 4.

The outer major flap 32 of economy carton 10 has, in the situation shown in FIG. 4, been provided with a through-going bead $F_1''$ of foamed adhesive material, dispensed from first front adhesive dispensing gun 41'', and with another through-going bead $R_1''$ of foamed adhesive material dispensed from first rear adhesive dispensing gun 51''. While the through-going bead $F_1''$ dispensed from first front adhesive dispensing 41'' extends close to the leading edge 37 of outer major flap 32, the other through-going bead $R_1''$ is positioned near the middle of outer major flap 32, the position of this through-going bead $R_1''$ being chosen so that this bead contacts the leading edge 35 of inner major flap 30 in the folded position thereof. Outer major flap 32 is further provided with beads $F_2''$ dispensed from second front adhesive dispensing gun 42'', which are provided only in the end sections of outer major flap 32, leaving the middle area of outer major flap 32 free to avoid waste of adhesive and sticking of packed granular goods to the flaps. These additional, not through-going beads $F_2''$ are positioned close to the fold line 36 of outer major flap 32.

Minor flaps 20, 22 are provided with beads $F_3''$, $F_4''$ dispensed from third and fourth front adhesive dispensing guns 43'', 44'', and with beads $R_2''$, $R_3''$ dispensed from second and third rear adhesive dispensing guns 52'', 53''. These beads on the exposed surfaces of minor flaps 20, 22 extend, as in all other embodiments discussed in this context, between the fold line and the leading edge of each minor flap and parallel with each other as well as with the other beads provided on the major flaps, and further parallel to the fold line 36, 34 of the major flaps 30, 32.

Inner major flap 30 is provided with non-through-going beads $F_5''$ and $R_4''$, $R_5''$ dispensed from fifth front adhesive dispensing gun 45'' and fourth and fifth rear adhesive dispensing guns 54'', 55'', respectively. All of the middle area of inner major flap 30 is free from foamed adhesive material, since this area is exposed to the carton's contents when folded down, like the middle area of the outer major flap close to the fold line thereof, as indicated above.

When inner major flap 30 is folded about its fold line 34 to contact the exposed surfaces of minor flaps 20, 22, the beads provided on minor flaps 20, 22 between fold line 34 and leading edge 35 of inner major flap 30 contact the beads dispensed onto the end sections of inner major flap 30, so that all said beads merge and form a continuous layer of foamed adhesive material, when inner major flap 30 is pressed down onto minor flaps 20, 22.

In this situation, with leading edge 35 of inner major flap 30 lying in the position indicated by discontinuous line 70 in FIG. 4, there is still a gap between leading edge 35 (line 70) of inner major flap 30 and fold line 36 of outer major flap 32. In this gap, the exposed surfaces of minor flaps 20, 22 are not covered by inner major flap 30.

When outer major flap 32 is now folded about fold line 36 into its folded position atop the exposed surfaces of minor flaps 20, 22 in the gap area and otherwise atop inner major flap 30, the non-through-going beads $F_2$ on outer major flap 32 contact the still exposed surfaces of minor flaps 20, 22 in the gap area. When folding down outer major flap 32, these beads $F_2''$ and the beads $R_2''$ disposed onto minor flaps 20, 22 in the gap area are spread out, merge, and form a continuous layer of foamed adhesive material, which fills the gap and extends from fold line 36 of outer major flap 32 to the leading edge 35 of downfolded inner major flap 30. Yet no adhesive is exposed to the carton's contents in the area between the leading edges of the minor flaps and the inner major flap.

The sift-proof seal is completed by through-going bead $R_1''$ dispensed onto outer major flap 32, which in the folded position of outer major 32 contacts the leading edge 35 of inner major flap 30, preferably at least partly embedding same, and connects the continuous layers of foamed adhesive material in the end sections of the major flaps 30, 32 atop minor flaps 20, 22.

Further through-going bead $F_1''$ of foamed adhesive material in this case serves to adhere outer major flap 32 firmly to inner major flap 30 close to the leading edge 37 of outer major flap 32.

Figure 5A:
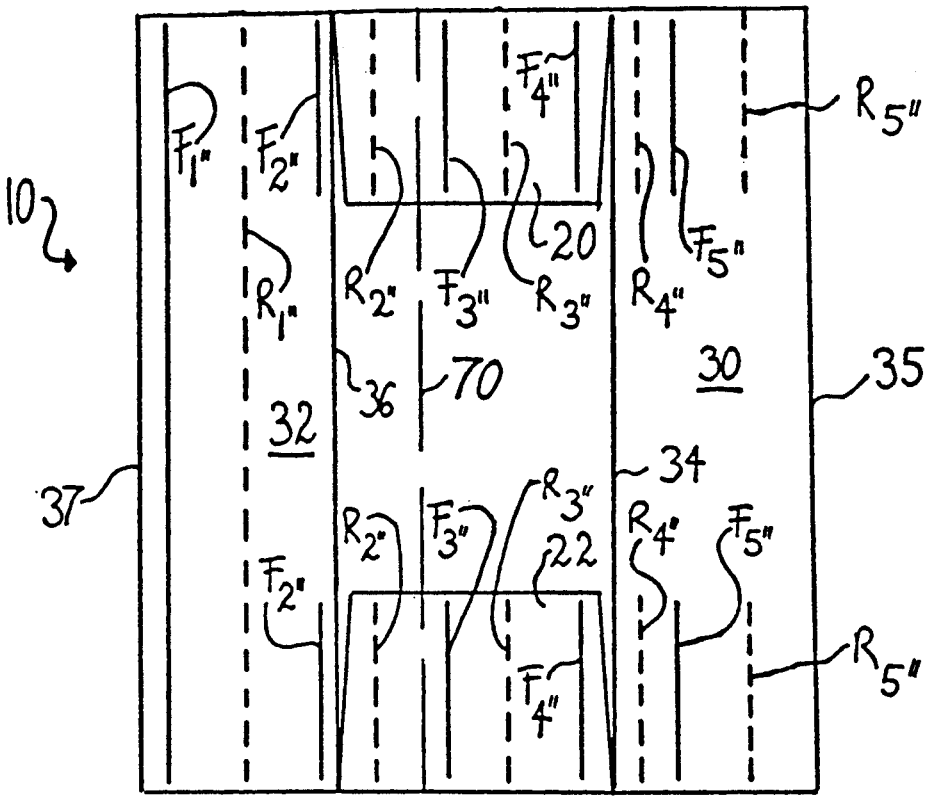

The strip or bead pattern shown in FIG. 5*a* is very similar to that notable from FIG. 4. It is produced by an array of dispensing guns similar to that of FIG. 4, but with the positions of strips $F_5''$ and $R_5''$ shifted towards the direction of the fold line 34.

Whereas on folding inner major flap 30 onto the minor flaps 20, 22 according to the embodiment of FIG. 4, strips $F_5''$ and $R_5''$ come to lie practically on top of strips $F_3''$ and $R_3''$, respectively, the strip pattern according to FIG. 5*a* produces an interdigitation of the beads on folding down the inner major flap 30.

Figure 5B:
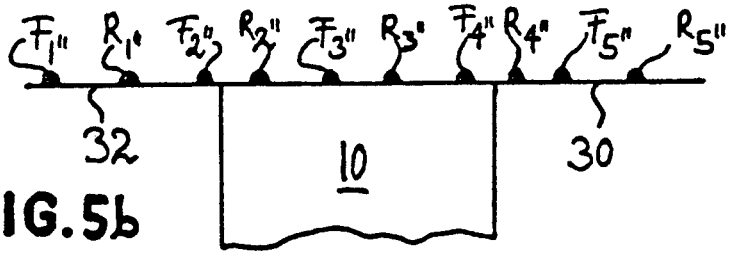
Figure 5C:
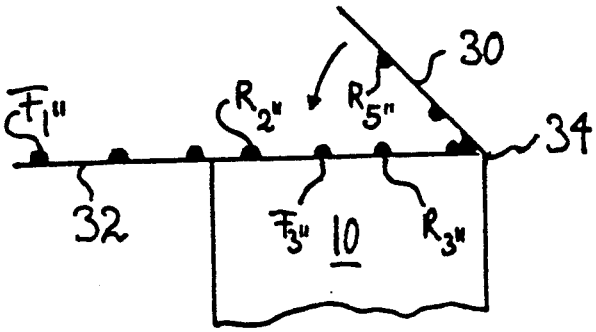

This is shown in FIG. 5*b* and 5*c*. As notable therefrom, strips $R_4''$ on folding down inner major flap 30 contact the minor flaps between the fold line 34 and strips $F_4''$, whereas the strips $F_5''$ on inner major flap 30 end up between strips $R_3''$ and $F_4''$ on the minor flaps, and strips $R_5''$ on inner major flap 30 contact the minor flaps 20, 22 between strips $F_3''$ and $R_2''$.

This interdigitation pattern enables the strips of foamed adhesive to be positioned maximally close to each other, so that production of a continuous layer of foamed adhesive on folding down inner major flap 30 is facilitated.

The function of adhesive strips $F_1''$, $R_1''$ and $F_2''$ on outer major flap 32 are the same as already described in connection with FIG. 4.

Figure 5D:
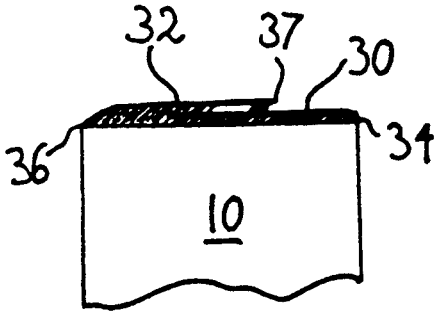

FIG. 5*d* finally shows the result of folding down both major flaps onto the minor flaps and each other, indicating the continuous layer of adhesive foamed in the end sections of the carton, and also showing the gaps remaining between the overlying portions of the outer major flaps. These gaps nevertheless are harmless, since the adhesive fulfills no sealing function in this area.

As will easily be noted from the above description, the invention provides a sift-proof seal of economy and other cartons by dispensing foamed hot melt adhesive onto the carton flaps in the course of a dispensing movement in only one direction, without slot nozzles being necessary. The invention therefore provides a simple and fast manufacture of cartons with a reliable sift-proof seal.

What is claimed is:

1. A method of providing a high integrity closure on a carton provided with opposed minor flaps, an inner major flap and an outer major flap, said inner and outer major flaps each having a leading side edge, opposed ends and a fold line for permitting inward folding thereof from a spread position, the method comprising:

dispensing an adhesive material onto said inner major flap and onto said outer major flap in their spread position to form at least one elongated first strip of adhesive material on each end of each of said inner and outer major flaps, and to form at least one second strip of adhesive material which extends continuously between said elongated first strips at said opposite ends of said outer major flap, said inner and outer major flaps each having exposed surfaces where no adhesive is present;

dispensing an adhesive material onto said minor flaps with said minor flaps in an inwardly folded position, said minor flaps each having exposed surfaces where no adhesive is present;

folding said inner major flap over said minor flaps so that said elongated first adhesive strip(s) on said inner major flap contact said exposed surfaces of said minor flaps, and so that an end layer of adhesive is formed between said inner major flap and said minor flaps at said opposite ends of said inner major flap;

folding said outer major flap over said inner major flap so that an end layer of adhesive is formed between said inner and outer major flaps at each of said opposite ends thereof, and so that said at least one second strip of adhesive formed on said outer major flap extends between and links said end layers of adhesive;

all of said strips of adhesive consisting of foamed adhesive material, and all of said strips of adhesive extending substantially parallel to one another in their direction of elongation.

2. The method of claim 1 in which said step of dispensing an adhesive material onto said inner and outer major flaps comprises:

dispensing a plurality of said first strips of foamed adhesive material onto each of said opposite ends of said inner major flap and dispensing at least one of said first strips of foamed adhesive material onto each of said opposite ends of said outer major flap such that said first strips of foamed adhesive on said inner major flap contact exposed surfaces of said minor flaps when folded thereon, and so that said at least one first strip of foamed adhesive on said outer major flap contacts an exposed surface of said inner major flap.

3. The method of claim 1 in which said step of dispensing an adhesive material onto said minor flaps, comprises:

dispensing at least one strip of foamed adhesive material onto each of said minor flaps in a position which is contacted by an exposed surface of said inner major flap or said outer major flap upon folding of said inner and outer major flaps inwardly from their spread position.

4. The method of claim 1 in which said step of dispensing an adhesive material onto said inner and outer major flaps comprises:

dispensing said at least one second strip of foamed adhesive material onto said outer major flap at a location adjacent said leading side edge thereof, said leading side edge of said outer major flap being at least partially embedded within said second strip of foamed adhesive material upon folding of said outer major flap over said inner major flap.

5. The method of claim 1 in which said steps of dispensing an adhesive material onto said inner and outer major flaps, and dispensing an adhesive material onto said minor flaps, comprise:

dispensing parallel first strips of foamed adhesive material onto said inner major flap, and dispensing parallel third strips of foamed adhesive material onto said minor flaps in locations such that upon folding said inner major flap onto said minor flaps said first strips and said third strips interdigitate with one another.

6. The method of claim 5 further comprising the step of pressing said inner major flap against said minor flaps to cause said first and third strips of foamed adhesive material to flow towards each other thus forming a complete seal across said minor flaps.

7. A method of providing a high integrity closure on a carton having carton walls defining a width dimension and carton walls defining a smaller depth dimension, opposed minor flaps each connected to carton walls defining the depth dimension of the carton and inner and outer major flaps each connected to carton walls defining the width dimension of the carton, said inner and outer major flaps each having a leading side edge and a fold line at a carton wall to permit folding thereof from a spread position toward the center of the carton, at least said inner major flap having a width dimension which is less than said depth dimension of the carton, the method comprising:

dispensing an adhesive material onto said inner major flap and onto said outer major flap in their spread position to form at least one elongated first strip of adhesive material on each end of each of paid inner and outer major flaps, and to form at least one second strip of adhesive material which extends continuously between said elongated first strips at said opposite ends of said outer major flap, said inner and outer major flaps each having exposed surfaces where no adhesive is present;

dispensing an adhesive material onto said minor flaps with said minor flaps in an inwardly folded position, said minor flaps each having exposed surfaces where no adhesive is present;

folding said inner major flap over said minor flaps so that a gap is formed on said minor flaps between said leading side edge of said inner major flap and said fold line of said outer major flap, said first adhesive strip(s) on said inner major flap contacting said exposed surfaces of said minor flaps forming an end layer of adhesive between said inner major flap and said minor flaps at opposite ends of said inner major flap;

folding said outer major flap over said inner major flap and said minor flaps so that:

(i) an end layer of adhesive is formed between said inner and outer major flaps at opposite ends thereof;

(ii) said at least one second strip of adhesive formed on said outer major flap extends between and links said end layers of adhesive; and (iii) at least one of said first strips of adhesive on said outer major flap extends over and fills said gap on said minor flaps between said leading edge of said inner major flap and said fold line of said outer major flap.

8. A high integrity closure carton, comprising:

spaced side walls defining a carton depth dimension therebetween, and spaced end walls defining a carton width dimension therebetween;

at least one pair of opposed minor flaps each having a flap surface and a fold line at one of said end walls, said minor flaps each being inwardly foldable from a spread position to a folded position;

at least one strip of adhesive extending along said flap surface of each said minor flaps;

at least one pair of opposed inner and outer major flaps each having a flap surface, a leading side edge and a fold line at one of said side walls, said inner and outer major flaps each having opposed ends which receive at least one strip of adhesive material in a position to contact an underlying flap surface upon folding of said inner major flap atop said minor flaps and upon folding said outer major flap atop said inner major flap and said minor flaps;

at least one strip of adhesive material extending between said opposed ends of said outer major flap substantially parallel to said fold line thereof;

all of said strips of adhesive being formed of foamed adhesive material, and all of said strips of adhesive extending substantially parallel to one another.

9. The carton of claim 8 in which said inner and outer major flaps each have a flap width dimension which is less than said carton depth dimension so that a gap is formed on said minor flaps between said leading side edge of said inner major flap and said fold line of said outer major flap and so that a gap is formed on said minor flaps between said leading side edge of said outer major flap and said fold line of said inner major flap with said inner and outer major flaps in a folded position, at least some of said strips of adhesive on at least one of said minor flaps, inner major flap and outer major flap being positioned to fill each of said gaps and form a high density closure thereat.

10. The carton of claim 8 in which said strip(s) of adhesive on said minor flaps interdigitate with said strip(s) of adhesive on at least one of said inner and outer major flaps.

11. Apparatus for dispensing adhesive material onto the opposed minor flaps and onto the opposed inner and outer major flaps of a carton with the minor flaps in an inwardly folded position and the inner and outer major flaps in a spread position relative to the center of the carton, comprising:

a plurality of adhesive dispensers each adapted to connect to a source of adhesive material, said adhesive dispensers each being formed with a discharge outlet for dispensing adhesive;

means for mounting said adhesive dispensers with respect to said flaps of the carton so that upon relative movement between said dispensers and the carton said dispensers discharge elongated, substantially parallel strips of adhesive from said discharge outlets thereof onto said minor flaps and said inner and outer major flaps;

means for operating said adhesive dispensers to obtain a pattern of said elongated, substantially parallel strips of adhesive which includes:

(i) at least one elongated, first adhesive strip on opposite ends of each of said inner and outer major flaps;

(ii) at least one elongated, second adhesive strip extending continuously between said first adhesive strips at opposite ends of said outer major flap; and (iii) at least one elongated, third adhesive strip on each of said minor flaps.

12. The apparatus of claim 11 in which said means for mounting said adhesive dispensers is effective to form a first row of adhesive dispensers and a second row of adhesive dispensers which are spaced from one another in the direction of relative movement between said carton and said adhesive dispensers, said adhesive dispensers in each of said rows being spaced from one another in a direction transverse to said direction of relative movement.

13. The apparatus of claim 12 in which said adhesive dispensers in said first row are misaligned from said adhesive dispensers in said second row in a direction transverse to said direction of relative movement between the carton and adhesive dispensers.

14. The apparatus of claim 11 in which said pattern of adhesive applied by said adhesive dispenser is such that said elongated first adhesive strip(s) applied to said inner major flap interdigitate with said elongated third adhesive strip(s) applied to said minor flaps.

15. The apparatus of claim 11 in which said inner major flap of the carton has a width dimension which is less than the depth dimension of the carton, said pattern of adhesive applied by said adhesive dispensers being such that said elongated first adhesive strip(s) applied to said outer major flap interdigitate with said elongated third adhesive strip(s) applied to said minor flaps.

* * * * *

UNITED STATES PATENT AND TRADEMARK OFFICE

CERTIFICATE OF CORRECTION

PATENT NO. : 5,016,812

DATED : May 21, 1991

INVENTOR(S) : Colin Pedigrew

It is certified that error appears in the above-identified patent and that said Letters Patent is hereby corrected as shown below:

In column 10, line 59, after "contribute to the", please insert --formation of the continuous adhesive layer at the--.

Signed and Sealed this

Twenty-third Day of March, 1993

*Attest:*

STEPHEN G. KUNIN

*Attesting Officer*

*Acting Commissioner of Patents and Trademarks*